United States Patent [19]

Lewis

[11] Patent Number: 4,964,184

[45] Date of Patent: Oct. 23, 1990

[54] FITTED TOP AND BOTTOM BEDSHEET COMBINATION

[76] Inventor: Doris Lewis, 73 Gamewell La., Willingboro, N.J. 08046

[21] Appl. No.: 370,318

[22] Filed: Jun. 22, 1989

Related U.S. Application Data

[63] Continuation-in-part of Ser. No. 86,984, Aug. 19, 1987, abandoned, and a continuation-in-part of Ser. No. 328,373, Mar. 24, 1989, abandoned.

[51] Int. Cl.[5] ..... A47G 9/02

[52] U.S. Cl. ..... 5/496; 5/498

[58] Field of Search ..... 5/494, 485, 497, 486, 5/495, 496, 498, 499, 502

[56] References Cited

U.S. PATENT DOCUMENTS 2,729,831 1/1956 Fuld et al. ..... 5/494

*Primary Examiner*—Eric K. Nicholson

*Attorney, Agent, or Firm*—Speery, Zoda & Kane

[57] ABSTRACT

A fitted top and bottom bedsheet combination is disclosed usable extending about a mattress to facilitate securement of the top sheet with respect to the mattress. The bedsheet combination includes a bottom bedsheet and a top bedsheet wherein the bottom bedsheet is fitted having a bottom main section and a first lateral bottom section and a second lateral bottom section and a head bottom section as well as a foot bottom section. Mattress securement means extend along a portion of the lowermost edge thereof to facilitate securement with respect to the mattress. The top bedsheet extends over the bottom bedsheet and is detachably secured adjacent the foot bottom section thereof, preferaby by Velcro. The top bedsheet further includes a first lateral top section extending downwardly on one side of the bed and a second top section extending downwardly on the other side of the bed. Mitered or non-mitered edges are included for preventing the pulling of the fitted combination out of contact with the underside of the mattress. Various types of gatherings or pleatings are utilized to facilitate some bunching of the top bedsheet to minimize pressure on the feet of the user.

24 Claims, 2 Drawing Sheets

FITTED TOP AND BOTTOM BEDSHEET COMBINATION

This application is a continuation-in-part of United Sates Ser. No. 07/086,984 filed 08/19/87, now abandoned and Unites States Ser. No. 07/328,373 filed Mar. 24, 1989 now abandoned.

BACKGROUND OF THE INVENTION

1. Field Of The Invention

The present invention deals with the field of bedsheet combinations adapted to provide a top bedsheet which is secured with respect to a bottom bedsheet which in turn is secured by elastic means as a fitted sheet with respect to the mattress therebelow. The present invention provides novel mitered or non-mitered edge configurations as well as pleating means of various configurations.

2. Description Of The Prior Art

A number of attempts have been made for advanced bedsheet combinations such as shown in U.S. Pat. No. 1,646,792 issued Oct. 25, 1927 to A. Moore on a Cover Holder; U. S. Pat. No. 1,865,329 issued June 28, 1932 to E. McHorter on Bed Clothing; U.S. Pat. No. 2,151,375 issued Mar. 21, 1939 to A. DeVoe on a Bedsheet; U.S. Pat. No. 2,498,055 issued Feb. 21, 1950 to W. Veit on Bedclothes; U.S. Pat. No. 2,569,627 issued Oct. 2, 1951 to M. Black on a Bed Sheet; U.S. Pat. No. 2,577,178 issued Dec. 4, 1951 to K. Bellinger on Bed Covering; U.S. Pat. No. 2,662,234 issued Dec. 15, 1953 to B. Citron on Bed Sheet Construction; U.S. Pat. No. 2,679,056 issued May 25, 1954 to G. Simpson on a Bedcover With Pocket; U.S. Pat. No. 2,695,414 issued Nov. 30, 1954 to J. Ford et al on an Article Of Bedding; U.S. Pat. No. 2,772,425 issued Dec. 4, 1956 to E. Brodie on a Bed Covering; U.S. Pat. No. 2,788,532 issued Apr. 16, 1957 to H. Christley on a Bed Cover; U.S. Pat. No. 3,254,348 issued June 7, 1966 to A. DiAddario on Bed Clothing; U.S. Pat. No. 3,258,789 issued July 5, 1966 to L. Banks on a Fitted Bed Sheet; U.S. Pat. No. 3,377,636 issued Apr. 16, 1968 to A. DiAddario on Bed Covering; U.S. Pat. No. 3,654,646 issued Apr. 11, 1972 to S. McMahon, Jr. on a Fitted Bed Covering; U.S. Pat. No. 3,868,735 issued Mar. 4, 1975 to M. Ross on a Top-Fitted Bed Sheet; U.S. Pat. No. 3,962,739 issued June 15, 1976 to L. Crockett on a Bedsheeting Arrangement; U.S. Pat. No. 4,021,869 issued May 10, 1977 to W. Root on a Fitted Top Sheet And Blanket; U.S. Pat. No. 4,035,854 issued July 19, 1977 to M. Pardee on a Mattress Cover; U.S. Pat. No. 4,245,365 issued Jan. 20, 1981 to H. Large on a Fitted Top Contour Sheet; U.S. Pat. No. 4,266,308 issued May 12, 1981 to M. Shatz on Bed Covering; U.S. Pat. No. 4,308,626 issued Jan. 5, 1982 to S. Weiss on a Fitted Top Sheet; U.S. Pat. No. 4,384,380 issued May 24, 1983 to K. Glaha et al on a Bedsheet Construction; U.S. Pat. No. 4,658,454 issued Apr. 21, 1987 to W. Potter on a Top And Bottom Bedsheet Combination Nonconfining To The Feet Of A Tall Person; and British Pat. No. 862,179 published Mar. 1, 1961 to A. Monier et al.

SUMMARY OF THE INVENTION

The present invention provides a fitted top and bottom bedsheet combination usable extending about a mattress on a bed which includes a bottom main section which extends generally horizontally to substantially cover all the upper surface of the mattress. A first lateral bottom section extends generally downwardly from one lateral side of the bottom main section and preferably is integral therewith to substantially cover one later side of the mattress therealong.

Similarly, a second lateral bottom section extends generally downwardly from and is attached with respect to the other lateral side of the bottom main section to substantially cover the other lateral side of the mattress. A head bottom section extends generally downwardly from and is attached with respect to the head end of the bottom main section to substantially cover the head end of the mattress therealong. Preferably the head bottom section is also integral with respect to the bottom main section.

A foot bottom section extends generally downwardly from and is attached with respect to the foot end of the bottom main section to thereby substantially cover the foot end of the mattress and preferably is integral with respect to the foot bottom section. A mattress securement means is secured along at least a portion of the lowermost edges of the first lateral bottom section, second lateral bottom section, head bottom section and foot bottom section to facilitate retaining of the bottom bedsheet means with respect to the mattress of the bed. This securement means can extend substantially along the entire lowermost edge of these four members or can be defined merely in the areas of intersection between these individual sections to facilitate grasping of the mattress in a standard configuration of a fitted bedsheet.

A top bedsheet means is preferably adapted to extend over at least a portion of the bottom main section of the bottom bedsheet means. The top bedsheet means preferably includes a top main section which extends substantially over the bottom main section and is detachably secured along the foot end thereof. Preferably this attach is by a Velcro means which is a hoop and loop type fastener. The top main section also includes a pleating or gathering adjacent to the point of attachment along the foot end thereof to provide some gathering of the material to provide space between the top and bottom main bedsheet for the body of a user to minimize rubbing against the materials. This gathering is particularly useful for the feet of a user being placed immediately adjacent to the sewn interconnection between the top bedsheet and the bottom bedsheet. The top bedsheet means further includes a first lateral top section extending downwardly from the top main section to extend over the first lateral bottom section. The first lateral top section including a first lower edge extending downwardly from the main section adjacent the foot bottom section.

A second lateral top section is preferably integral with respect to the top main section and extends downwardly therefrom to extend over the second lateral bottom section. This second lateral top section includes a second lower edge extending downwardly from the top main section adjacent to the foot bottom section.

Preferably the fitted top and bottom bedsheet combination will include the first lateral bottom section, the second lateral bottom section, the head bottom section and the foot bottom section all being integral with respect to one another. Furthermore, the combination will also include the top main section and the first lateral top section and the second lateral top section all integral with respect to one another. These two sections should preferably be formed of a single sheet of material.

Preferably the first lower edge will extend approximately vertically downward adjacent the intersection between the first lateral bottom section and the foot bottom section. Similarly preferably the second lower edge will extend approximately vertically downwardly adjacent the intersection between the second lateral bottom section and the foot bottom section. This will provide a vertically downwardly extending clean-look of conventional bedding to this non-conventional bedsheet combination. This will also facilitate tucking of the first lateral top section and the second lateral top section under the mattress if such a look is desired.

The first lower edge of the first lateral top section may also extend downwardly and obliquely away from the foot bottom section to provide the look of a mitered top and bottom bedsheet combination. Similarly the second lower edge of the second lateral top section can extend downwardly and obliquely away from the foot bottom section to provide a mitered look to the opposite side of the bedsheet combination.

This mitered look can be provided by cutting of the first lateral top section or second lateral top section away from the foot bottom section. Alternatively the mitered look can be provided by the conventional vertical cut being sewn backwardly at a 45% angle such that the flap will be hidden and provide the 45% mitered look.

The pleatings of the present invention may include a first pleat and a second pleat generally positioned adjacent to one another defined in the top main section adjacent to the point of securement thereof with respect to the bottom main section. The first and second pleats can extend in opposite outwardly directed relative positions in order to facilitate maximum bunching of the material of the top bedsheet means adjacent to the foot bottom section or alternatively can extend both in the same direction to provide a different look for the top sheet main section.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
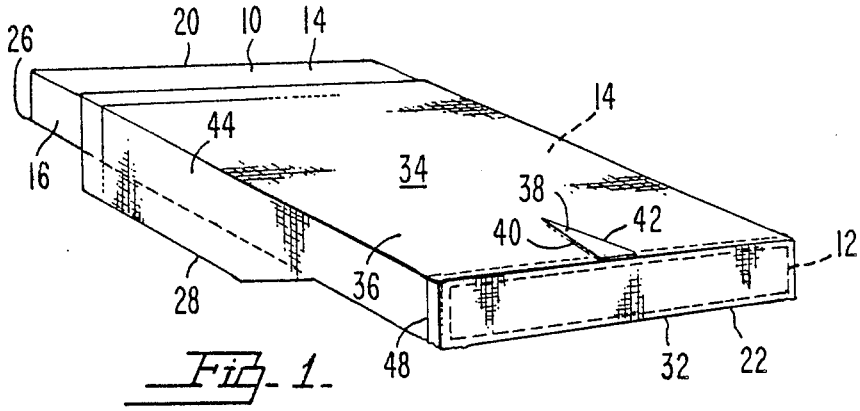
FIG. 1 is a top perspective view of an embodiment of the fitted top and bottom bedsheet combination of the present invention shown in position extending about a mattress on a bed.

The present invention provides a bottom bedsheet means 10 which is adapted to extend substantially across the entire upper surface of a mattress 12. Bottom bedsheet means 10 includes a bottom main section 14 extending over the entire upper surface of mattress 12 and a first lateral bottom section 16 extending downwardly therefrom along one side mattress 12 and a second lateral bottom section 18 extending downwardly along the opposite lateral edge of mattress 12.

A head bottom section 20 extends downwardly along the downwardly extending head area of mattress 12 and the foot bottom section 22 extends downwardly along the foot section of mattress 12. In this manner the entire upper surface and four lateral sides of mattress 12 will be encapsulated by the bottom bedsheet means 10.

To facilitate encapsulating, securement sections 25 may be included extending from first and second lateral bottom sections 16 and 18 to top and bottom sections 20 and 22 of the bottom bedsheet means 10 in such a manner as to form small triangles of material extending therebetween to facilitate securement to the mattress 12.

Alternatively, an encapsulating resilient elastic means 24 may extend along at least a portion of the lowermost edges of the bottom bedsheet means 10. These lowermost edges include lowermost edge 26 of bottom main section 14, and lowermost edge 28 of first lateral bottom section 16 and lowermost edge 30 of second lateral bottom section 18 and lowermost edge 32 of head bottom section 20. Preferably the resilient elastic means 24 will be secured at least along the corners of mattress 12 to facilitate securement of bottom bedsheet means 10 with respect to mattress 12 in a similar manner to a conventional fitted bedsheet.

A top bedsheet means 34 is adapted to extend substantially across the upper surface of bottom bedsheet means 10. Top bedsheet means 34 includes a top main section 36 which is detachably secured along the foot edge thereof with respect to the bottom main section 14 of bottom bedsheet means 10. This securement preferably is in the form of a detachably securable connection formed by Velcro means 34 located immediately along the bottom upper edge of mattress 12 adjacent to the downwardly extending foot bottom section 22 of bottom bedsheet means 10. Top mains section 36 will thereby be detachably secured with respect to the mattress 12 in a similar fashion to the fitted securement of the bottom bedsheet means 10 and thereby will not be capable of being pulled out which is a common problem with top bedsheets. The detachable securement means 56 greatly facilitates laundering of the top and bottom bedsheet means 34 and 10.

To facilitate convenience and movement of a user's body and particularly a user's feed between the top bedsheet means 34 and the bottom bedsheet means 10 a gathering or pleating means 38 can be defined in the top bedsheet means 34. This gathering means will facilitate bunching of the material of the top bedsheet means 34 with respect to the bottom bedsheet means 10 to minimize abrasion of the material of the two bedsheets with respect to the feet of a user.

Figure 4:
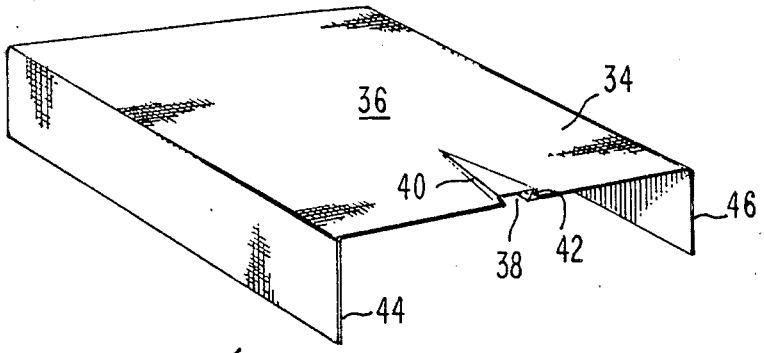
FIG. 4 is a perspective view of an embodiment of the bedsheet combination of the present invention showing an outwardly oppositely, pleated top main section.
Figure 5:
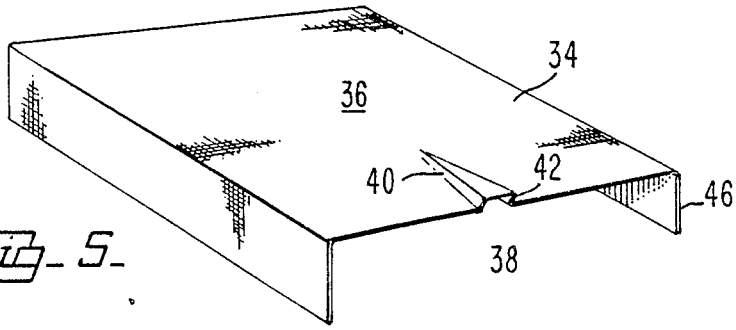
FIG. 5 shows an embodiment of a top and bottom bedsheet combination of the present invention showing two pleats extending in the same direction defined on a top main section.
Figure 7:
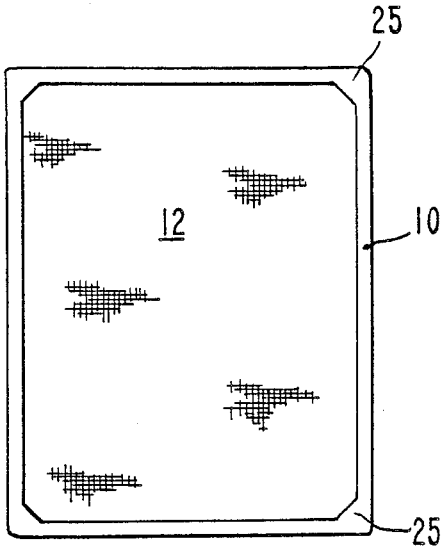
FIG. 7 is a bottom plan view of an embodiment of the bedsheet combination of the present invention showing the bottom bedsheet means secured to the mattress utilizing securement sections.

Pleating means 38 preferably includes a first pleat 40 and a second pleat 42. As shown in FIG. 4 first pleat 40 may extend outwardly with respect to the direction of second pleat 42 to facilitate the amount of bunching of the top bedsheet means 34. Alternatively for a different look the first pleat 40 and the second pleat 42 may extend in the same direction as shown in FIG. 5 to provide a different overall look.

The top bedsheet means 34 includes a first lateral top section 44 extending downwardly over the first lateral bottom section 16 of bottom bedsheet means 10. Also top bedsheet means 34 includes a second lateral top section 46 extending generally downwardly over the second lateral bottom section 18 of bottom bedsheet means 10.

Figure 2:
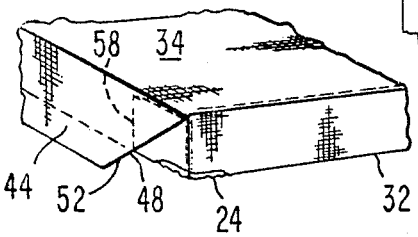
FIG. 2 is a perspective view of a corner of an embodiment of the top and bottom bedsheet combination of the present invention showing a mitered edge-look.
Figure 6:
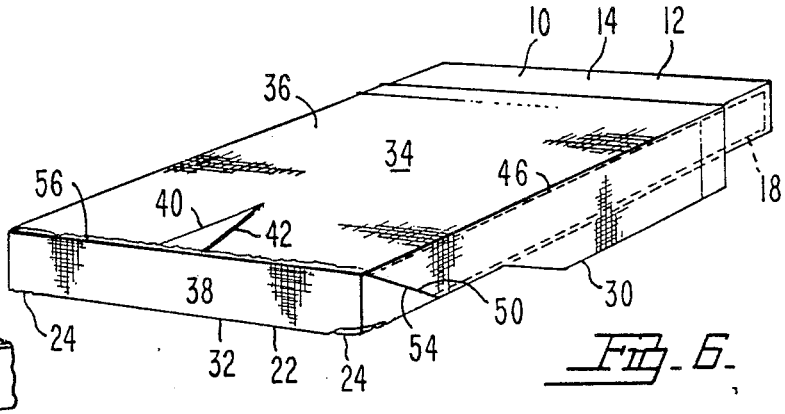
FIG. 6 is a right three-quarter perspective view of the embodiment shown in FIG. 1.
Figure 3:
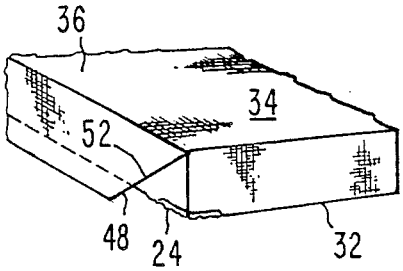
FIG. 3 is a perspective view of a corner of an embodiment of the top and bottom bedsheet combination of the present invention showing a cut mitered edge-look.

First lateral top section 44 will include a first lower edge 48 positioned adjacent to the inner section between the first lateral bottom section 16 and the foot bottom section 22. This downwardly extending edge can be oriented approximately straight downwardly to define a clean vertical cut and also to facilitate possible tucking under the mattress 12. Alternatively the first lower edge 48 may form a first mitered edge 52. This mitered edge can be formed by folding back the material at a 45% angle as shown in FIG. 2 to form the 45% mitered edge 48. Alternatively the material can be cut at a 45% angle to eliminate the excess material as shown in FIG. 3. Similarly the second lateral top section 46 can define a second lower edge 50 adjacent the second lateral bottom section 18 and adjacent the foot bottom section 22. This opposite side second lower edge 50 may also be a second mitered edge 54 and can be formed in the same two ways above described, that is by folding back the material at 45% or by cutting of the material. The back fold 58 is shown in FIG. 2.

In the composite overall structure of the bedsheet combination of the present invention, the use of an attachment 56 between the bottom bedsheet means 10 and the top bedsheet means 34 provides a novel combination which eliminates the possibility of pulling of the top bedsheet means out from attachment with respect to the mattress. The pulling of the top bedsheet out is minimized due to its connection with respect to a fitted bottom sheet. Also the novel combination of possibilities of the look of the bedsheet being possibly vertical or mitered at a 45% angle provides a verstility in usage of the present invention which is not shown in any of the prior art. Also the location and specific construction of the gathering means 38 is of a distinct advantage in preventing unwanted abrasions with the user during normal nighttime movements during usage of this bedsheet combination.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A fitted top and bottom bedsheet combination usable extending about a mattress on a bed comprising:

(a) a bottom bedsheet means adapted to extend generally about the mattress including:

(1) a bottom main section extending generally horizontally covering substantially all of the upper surface of the mattress;

(2) a first lateral bottom section extending generally downwardly from and attached with respect to one lateral side of said bottom main section to substantially cover one lateral side of the mattress therealong;

(3) a second lateral bottom section extending generally downwardly from and attached with respect to the other lateral side of said bottom main section to substantially cover the other lateral side of the mattress therealong;

(4) a head bottom section extending generally downwardly from and attached with respect to the head end of said bottom main section to substantially cover the head end of the mattress therealong;

(5) a foot bottom section extending generally downwardly from and attached with respect to the foot end of said bottom main section to substantially cover the foot end of the mattress therealong;

(6) a mattress securement means along at least a portion of the lowermost edge of said first lateral bottom section, said second lateral bottom section, said head bottom section and said foot bottom section to retain said bottom bedsheet means with respect to the mattress of the bed;

(b) a top bedsheet means adapted to extend at least partially over said bottom main section of said bottom bedsheet means, said top bedsheet means including:

(1) a top main section detachably secured directly to said bottom main section immediately adjacent said bottom foot section, said top main section extending substantially horizontally over said bottom main section, said top main section including a gathering means adjacent said foot bottom section;

(2) a first lateral top section extending downwardly from said top main section to extend over said first lateral bottom section, said first lateral top section including a first lower edge extending downwardly from said top main section adjacent said foot bottom section; and (3) a second lateral top section extending downwardly from said top main section to extend over said second lateral bottom section, said second lateral top section including a second lower edge extending downwardly from said top main section adjacent said foot bottom section.

2. A fitted top and bottom bedsheet combination as defined in claim 1 wherein said bottom main section, said first lateral bottom section, said second lateral bottom section, said head bottom section and said foot bottom section are all integral with respect to one another.

3. A fitted top and bottom bedsheet combination as defined in claim 1 wherein said top main section, said first lateral top section and said second lateral top section are all integral with respect to one another.

4. A fitted top and bottom bedsheet combination as defined in claim 1 wherein said first lower edge and said second lower edge each extending approximately vertically downwardly adjacent the intersection between said first lateral bottom section and said foot bottom section and adjacent the intersection between said second lateral bottom section and said foot bottom section, respectively in order to facilitate tucking of said first lateral top section and said second lateral top section under the mattress if desired.

5. A fitted top and bottom bedsheet combination as defined in claim 1 wherein said first lower edge of said first lateral top section extends downwardly and obliquely away from said foot bottom section to provide a mitered-look to the fitted top and bottom bedsheet combination.

6. A fitted top and bottom bedsheet combination as defined in claim 1 wherein said second lower edge of said second lateral top section extends downwardly and obliquely away from said foot bottom section to provide a mitered-look to the fitted top and bottom bedsheet combination.

7. A fitted top and bottom bedsheet combination as defined in claim 5 wherein said first lateral top section is folded back and attached in place at said first lower edge to provide the mitered-look to the fitted top and bottom bedsheet combination.

8. A fitted top and bottom bedsheet combination as defined in claim 6 wherein said second lateral top section is folded back and attached in place at said second lower edge to provide the mitered-look to the fitted top and bottom bedsheet combination.

9. A fitted top and bottom bedsheet combination as defined in claim 1 wherein said mattress securement means is a resilient elastic means.

10. A fitted top and bottom bedsheet combination as defined in claim 9 wherein said resilient elastic means is secured along the intersection between said first lateral bottom section and said head bottom section, and along the intersection between said head bottom section and said second lateral bottom section, and along the intersection between said second lateral bottom section and said foot bottom section and along the intersection between said foot bottom section and said first lateral bottom section.

11. A fitted top and bottom bedsheet combination as defined in claim 1 wherein said gathering means is a pleating means.

12. A fitted top and bottom bedsheet combination as defined in claim 11 wherein said pleating means includes a first pleat and a second pleat generally adjacent to one another.

13. A fitted top and bottom bedsheet combination as defined in claim 12 wherein said first pleat and said second pleat extend in the same direction.

14. A fitted top and bottom bedsheet combination as defined in claim 12 wherein said first pleat and said second pleat extend toward said first lateral top section.

15. A fitted top and bottom bedsheet combination as defined in claim 11 wherein said first pleat and said second pleat extend toward said second lateral top section.

16. A fitted top and bottom bedsheet combination as defined in claim 1 wherein said mattress securement means comprises a securement section of material secured along at least a portion of the lowermost edge of said first lateral bottom section, said second lateral bottom section, said head bottom section and said foot bottom section to retain said bottom bedsheet means with respect to the mattress of the bed.

17. A fitted top and bottom bedsheet combination as defined in claim 1 wherein said top main section is detachably secured directly to said bottom main section.

18. A fitted to and bottom bedsheet combination as defined in claim 1 further comprising a hook and loop type fastener detachable securement means fixedly secured with respect to said top main section and fixedly secured with respect to said bottom main section to facilitate detachable securement therebetween.

19. A fitted top and bottom bedsheet combination usable extending about a mattress on a bed comprising:

(a) a bottom bedsheet means adapted to extend generally about the mattress including:

(1) a bottom main section extending generally horizontally covering substantially all of the upper surface of the mattress;

(2) a first lateral bottom section extending generally downwardly from and integral with respect to one lateral side of said bottom main section to substantially cover one lateral side of the mattress therealong;

(3) a second lateral bottom section extending generally downwardly from and integral with respect to the other lateral side of said bottom main section to substantially cover the other lateral side of the mattress therealong;

(4) a head bottom section extending generally downwardly from and integral with respect to the head end of said bottom main section to substantially cover the head end of the mattress therealong;

(5) a foot bottom section extending generally downwardly from and integral with respect to the foot end of said bottom main section to substantially cover the foot end of the mattress therealong;

(6) a securement section means secured along at least a portion of the lowermost edge of said first lateral bottom section, said second lateral bottom section, said head bottom section and said foot bottom section to retain said bottom bedsheet means with respect to the mattress of the bed, said securement section means being secured between said first lateral bottom section and said head bottom section, and between said head bottom section and said second lateral bottom section, and between said second lateral bottom section and said foot bottom section and between said foot bottom section and said first lateral bottom section;

(b) a top bedsheet means adapted to extend at least partially over said bottom main section of said bottom bedsheet means, said top bedsheet means including:

(1) a top main detachably secured directly to said bottom main section immediately adjacent said bottom foot section, said top main section extending substantially horizontally over said bottom main section, said top main section including a pleating means adjacent said foot bottom section, said pleating means including a first pleat means and a second pleat means positioned adjacent with respect to one another and oriented facing outwardly with respect to one another;

(2) a first lateral top section extending downwardly from and integral with said top main section to extend over said first lateral bottom section, and first lateral top section including a first lower edge extending downwardly from said top main section adjacent said foot bottom section; and (3) a second lateral top section extending downwardly from and integral with said top main section to extend over said second lateral bottom section, said second lateral top section including a second lower edge extending downwardly from said top main section adjacent said foot bottom section.

20. A fitted top and bottom bedsheet combination as defined in claim 19 wherein said first lower edge and said second lower edge each extending approximately vertically downwardly adjacent the intersection between said first lateral bottom section and said foot bottom section and adjacent the intersection between said second lateral bottom section and said foot bottom section, respectively in order to facilitate tucking of said first lateral top section and said second lateral top section under the mattress if desired.

21. A fitted top and bottom bedsheet combination as defined in claim 19 wherein said first lower edge of said first lateral top section extends downwardly and obliquely away from said foot bottom section to provide a mitered-look to the fitted top and bottom bedsheet combination.

22. A fitted top and bottom bedsheet combination as defined in claim 19 wherein said second lower edge of said second lateral top section extends downwardly and obliquely away from said foot bottom section to provide a mitered-look to the fitted top and bottom bedsheet combination.

23. A fitted top and bottom bedsheet combination as defined in claim 22 wherein said first lateral top section is folded back and attached in place at said first lower edge to provide the mitered-look to the fitted top and bottom bedsheet combination.

24. A fitted top and bottom bedsheet combination as defined in claim 21 wherein said second lateral top section is folded back and attached in place at said second lower edge to provide the mitered-look to the fitted top and bottom bedsheet combination.

* * * * *

UNITED STATES PATENT AND TRADEMARK OFFICE

CERTIFICATE OF CORRECTION

PATENT NO. : 4,964,184

DATED : October 23, 1990

INVENTOR(S) : Doris Lewis

It is certified that error appears in the above-identified patent and that said Letters Patent is hereby corrected as shown below:

On the cover page, after "Attorney, Agent, Or Firm" change "Speery" to -- Sperry --.

In column 8, line 49, after "main" insert -- section --.

Signed and Sealed this

Twenty-fourth Day of November, 1992

*Attest:*

DOUGLAS B. COMER

*Attesting Officer*

*Acting Commissioner of Patents and Trademarks*